US005415493A

United States Patent [19]

Eaton

[11] Patent Number: 5,415,493

[45] Date of Patent: May 16, 1995

[54] SNOW PLOW COMPATIBLE SPEED BUMPS

[75] Inventor: Robert A. Eaton, East Thetford, Vt.

[73] Assignee: The United States of America as represented by the Secretary of the Army, Washington, D.C.

[21] Appl. No.: 198,712

[22] Filed: Feb. 18, 1994

Related U.S. Application Data

[63] Continuation-in-part of Ser. No. 45,350, Apr. 13, 1993, Pat. No. 5,295,759.

[51] Int. Cl.[6] ..... E01F 9/047

[52] U.S. Cl. ..... 404/15

[58] Field of Search ..... 14/15, 16

[56] References Cited

U.S. PATENT DOCUMENTS

| | | | |
|---|---|---|---|
| 3,975,108 | 8/1976 | Suhr et al. | 404/16 |
| 4,687,370 | 8/1987 | Knowles | 404/15 |
| 4,697,294 | 10/1987 | Schafer | 404/16 X |
| 5,106,226 | 4/1992 | Fanslow et al. | 404/15 |
| 5,295,759 | 3/1994 | Flanders et al. | 404/15 |

FOREIGN PATENT DOCUMENTS

| | | | |
|---|---|---|---|
| 2596081 | 9/1987 | France | 404/16 |
| 2030197 | 4/1980 | United Kingdom | 404/15 |
| 2079356 | 1/1982 | United Kingdom | 404/15 |
| 2104946 | 3/1983 | United Kingdom | 404/16 |

*Primary Examiner*—Michael Powell Buiz
*Assistant Examiner*—James A. Lisehora
*Attorney, Agent, or Firm*—Luther A. Marsh

[57] ABSTRACT

A speed bump for use in connection with roadways located in climates where a snow plow is used to clear the roadways. The speed bump comprises two raised masses that extend across the traffic lanes of a roadway, each having a crown of fixed width running substantially the length of each bump, a gap of fixed width lying in parallel and in between the two raised masses, the leading edge of the first raised mass is tapered to allow a snow plow to smoothly lift over the mass, the trailing edge of the first raised mass is relatively steep to provide the desired speed control, the leading edge of the second raised mass is relatively steep, the trailing edge of the second raised mass is tapered, the gap between the two raised masses provides the desired speed control by allowing the tire to gradually rise up the tapered leading edge of the first raised mass before abruptly dropping down, then abruptly rising back up the second raised mass leading edge and then gently rolling away down the tapered trailing edge of the second raised mass, the abrupt drop and bump back up serves to control vehicular speed.

2 Claims, 2 Drawing Sheets

SNOW PLOW COMPATIBLE SPEED BUMPS

STATEMENT OF GOVERNMENT INTEREST

The invention described and claimed herein may be manufactured and used by or for the Government of the United States of America for governmental purposes without the payment of royalties thereon or therefor.

This case is a continuation-in-part of patent application of STEPHEN N. FLANDERS ET AL. having Ser. No. 08/045,350, filed on Apr. 13, 1993, now U.S. Pat. No. 5,295,759.

FIELD OF INVENTION

The present invention pertains to speed bumps of the type used to control the speed of vehicular traffic on roads and, more particularly, to such speed bumps which are compatible with the use of snow plows.

DESCRIPTION OF PRIOR ART

Speed bumps are an effective means of preventing excessive speeds on roads. A conventional speed bump consists of a ridge extending transversely to the direction of traffic flow across one or more lanes of the roadway. These speed bumps are normally formed of paving material, such as asphalt or concrete, and have a cross-sectional configuration approximating that of a segment of a circle with a sharp angle of intersection with the pavement surface. This sharp angle presents an obstacle for snow plows requiring careful operation on the part of the plow operator to avoid damage to the speed bumps and to the snow plow equipment. One approach to this problem has been the use of removable speed bumps. This, however, requires manual removal and installation, according to the season, and the desired traffic control is, obviously, lacking during the winter season.

A second approach is the use of speed dips rather than speed bumps. Speed dips involve cutting into the existing pavement surface which may contribute to the deterioration thereof.

SUMMARY OF THE INVENTION

It is the primary object of the present invention to provide a speed bump which is compatible with the use of snow plows on the road surface while maintaining the traffic control aspects of the bump.

It is also an object of the present invention to provide such speed bumps which are permanent road features.

A further object of the present invention is the provision of permanent, snow plow compatible speed bumps which are formed of conventional road construction materials.

The above and other objects of the present invention are achieved by the provision of a first raised masses having tapered leading edge that slopes upwardly providing a smooth transition from the pavement surface to the speed bump allowing a plow to lift over the bump, without jarring the plow or permitting unacceptable wear or damage to the speed bump. The trailing edge of the first raised mass is of a conventional speed bump shape. A second raised mass lies in a range from about one to about twelve inches in proximity to the first raised mass. The second raised mass has a leading edge of a conventional speed bump shape. The trailing edge of the second raised mass is tapered downwardly. The two raised masses are in parallel and adjacent to each other. A gap is located between the two raised masses to provide the desired speed control.

For a more complete understanding of the invention and the objects and advantages thereof, reference should be had to the accompanying drawings and the following detailed description wherein preferred embodiments of the invention are illustrated and described.

DESCRIPTION OF THE PREFERRED EMBODIMENT

Suitable materials of which the speed bumps are made include, but are not limited to, asphalt, asphalt concrete, portland cement concrete, high-density elastomeric plastic such as neoprene or polyurethane, or metal such as aluminum or corrosion-resistant steel.

Figure 1:
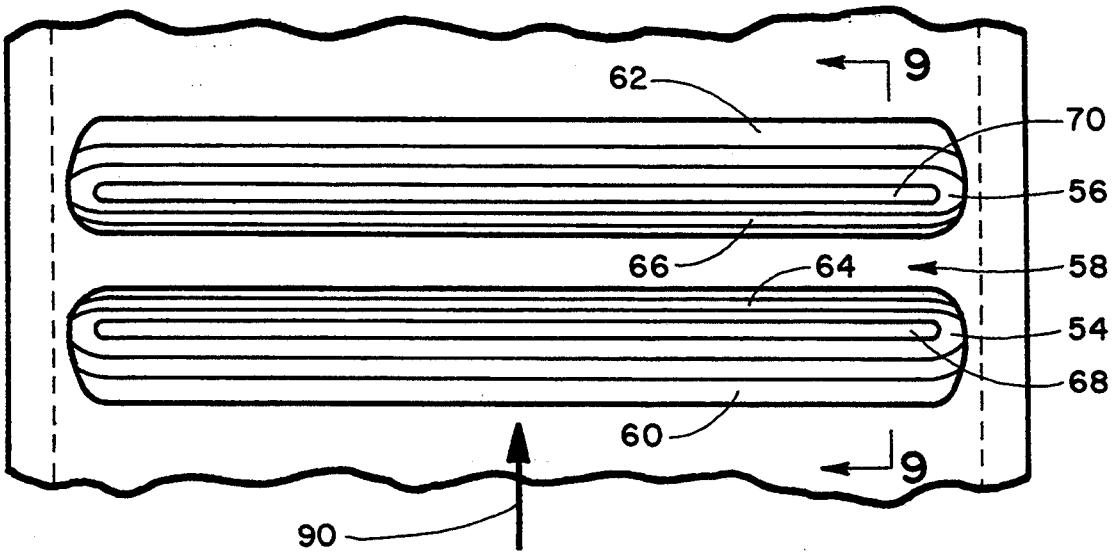
FIG. 1 is a plan view of the snow plow compatible speed bumps of the present invention.
Figure 2:
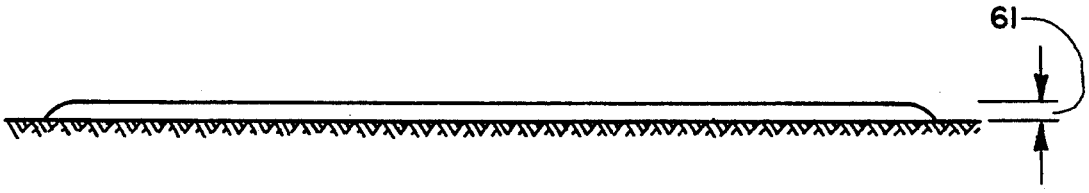
FIG. 2 is a side elevational view of the first raised mass of FIG. 1.
Figure 3:
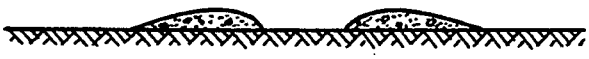
FIG. 3 is a transverse cross sectional view taken on line 9—9 of FIG. 1.
Figure 4:
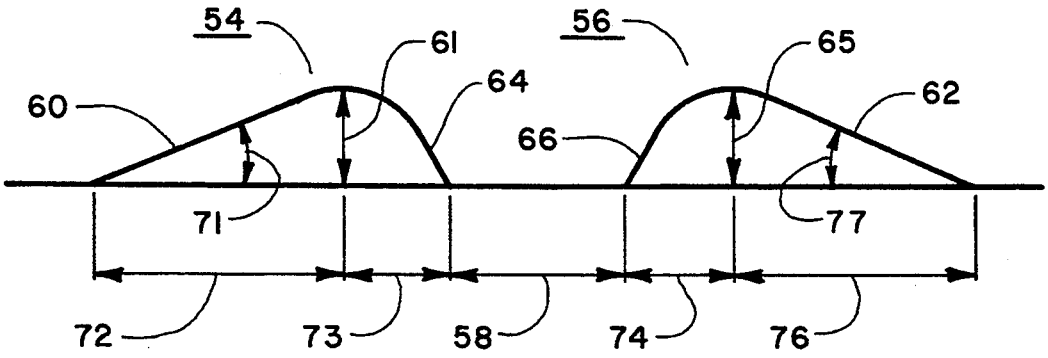
FIG. 4 is a transverse cross sectional view taken on line 9—9 of FIG. 1 with its dimensions labeled.
Figure 5:
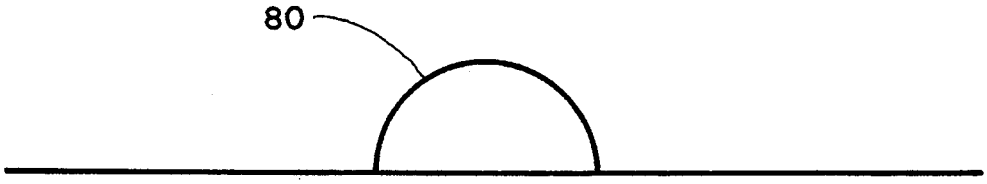
FIG. 5 PRIOR ART
FIG. 5 is a cross sectional view of a conventional speed bump.

A conventional speed bump 80 which is not snow plow compatible is depicted in FIG. 5. The embodiment of the present invention is illustrated in FIGS. 1, 2, 3 and 4. In this embodiment, two raised masses 54 and 56 extend across the traffic lanes of the roadway and are separated by a gap 58. The two raised masses 54 and 56 have crowns of fixed width running substantially the length of each mass. As seen from the direction of traffic 90, the leading edge 60 of raised mass 54 and the trailing edge 62 of each raised mass 56 are tapered and have an incline at an angle 71 and 77, respectively, not exceeding about 22.5 degrees. This, provides a smooth transition for the plow blade. The trailing edge 64 of the raised mass 54 and the leading edge 66 of the second raised mass 56, which face one another, are of a conventional speed bump shape and are relatively steep so that they, together with the gap 58, provide the desired speed control.

The tapered leading edge 60 of the first raised mass 54 has a width 72 about twice that of the width 73 of the trailing edge 64. The leading edge 66 of the second raised mass 56 has a width 74 that is about half the width 76 of the trailing edge 62. This configuration also contributes to the adequate speed control without damaging a snow plow blade.

The raised masses 54 and 56 are about the same height 61 and 65, respectively. The height 61 and 65 can range from about one to ten inches depending on the vehicle clearance required.

The trailing edge 64 of the first raised mass 54 has a width 73 that is greater than the height 61 and the trailing edge 64 has a width 73 that is less than the width 72 of the leading edge 60 of the first raised mass 54.

The leading edge 66 of the second raised mass 56 has a width 74 that is greater than the height 65 and the leading edge 66 has a width 74 that is less than the width 76 of the trailing edge 62 of the second raised mass 56.

The gap 58 lies in between the two raised masses 54 and 56. The gap 58 has a fixed width extending the length of both masses. The gap 58 has a width ranging from about one to about twenty-four inches.

The gap 58 provides the desired speed control by allowing the tire to gradually rise up the tapered leading edge 60 before abruptly dropping down, then abruptly rising back up the leading edge 66 and then gently rolling away down the tapered trailing edge 62. The abrupt drop and bump back up serves to control vehicular speed.

The preferred dimensions include having the width of the gap 58 be a fixed width about equal to that of the width of each of the edges 64 and 66. The overall height of each of the raised masses should equal half the width of the gap 58. The preferred dimensions are having the width of the gap 58 be about eight inches, the width of each of the edges 64 and 66 be about eight inches and the width of the edges 60 and 62 be about sixteen inches where the overall height of the construction is about four inches.

While the preferred embodiment of the invention has been illustrated and described in detail herein, changes and additions may be had therein and thereto without departing from the spirit of the invention. Reference should, accordingly, be had to the appended claims in determining the true scope of the invention.

What is claimed is:

1. A speed bump for use in connection with roadways located in a climate where a snow plow is used to clear a roadway comprising:

a first raised mass fabricated from roadway construction material;

said first raised mass extending across a traffic lane of a roadway;

said first raised mass having a crown of fixed width running substantially the length of said first raised mass;

said first raised mass having a tapered leading edge, as seen from the direction of traffic, and a trailing edge, said leading edge having a width about twice that of said trailing edge;

said tapered leading edge having an incline not exceeding about 22.5 degrees;

said first raised mass having a height ranging from about one to about ten inches;

said trailing edge of said first raised mass having a width greater than the height of said first raised mass and having a width that is less than the width of said leading edge of said first raised mass;

a second raised mass lying in parallel to and adjacent to said first raised mass from about one to about twelve inches in proximity;

said second raised mass made of roadway construction material;

said first raised mass and said second raised are about the same height;

said second raised mass extending across a traffic lane of said roadway;

said second raised mass having a crown of fixed width running substantially the length of said second raised mass;

said second raised mass having a leading edge, as seen from the direction of traffic, and a tapered trailing edge, said leading edge having about half the width of said trailing edge;

said trailing edge having an incline not exceeding about 22.5 degrees;

a second raised mass having a height ranging from about one to about ten inches;

said leading edge of said second raised mass having a width that is greater than the height of said second raised mass and having a width that is less than the width of said trailing edge of said second raised mass;

a gap lying in between said first and second raised masses;

said gap having a fixed width extending the length of said raised masses; and said fixed width ranging from about one inch to about twenty-four inches.

2. The speed bump of claim 1 wherein said roadway construction material is selected from the group consisting of asphalt, asphalt concrete, portland cement concrete, high-density elastomeric plastic, and corrosion-resistant metal.

* * * * *